US006979220B1

(12) United States Patent
Ray et al.

(10) Patent No.: US 6,979,220 B1
(45) Date of Patent: Dec. 27, 2005

(54) PLUG LOCKING MECHANISM

(75) Inventors: Richard C. Ray, Orem, UT (US); Jonathan L. Rhees, Riverton, UT (US); Martin D. Eastwood, Pleasant Grove, UT (US); Ryan A. Kunz, Riverton, UT (US)

(73) Assignee: Card Access, Inc., American Fork, UT (US)

( * ) Notice: Subject to any disclaimer, the term of this patent is extended or adjusted under 35 U.S.C. 154(b) by 0 days.

(21) Appl. No.: 10/610,845

(22) Filed: Jun. 29, 2003

(51) Int. Cl.[7] ..... H01R 13/625
(52) U.S. Cl. ..... 439/346; 439/347
(58) Field of Search ..... 439/346, 652, 439/347, 134, 135

(56) References Cited

U.S. PATENT DOCUMENTS

| | | | | |
|---|---|---|---|---|
| 3,942,856 | A * | 3/1976 | Mindheim et al. | 439/346 |
| 4,085,991 | A * | 4/1978 | Marshall et al. | 439/346 |
| 4,136,919 | A * | 1/1979 | Howard et al. | 439/346 |
| 4,157,855 | A * | 6/1979 | Chan | 439/346 |
| 4,348,696 | A | 9/1982 | Beier | 358/188 |
| 4,484,220 | A | 11/1984 | Beetner | 358/190 |
| 4,969,833 | A * | 11/1990 | Lindow et al. | 439/346 |
| 5,046,157 | A | 9/1991 | Smith et al. | 340/309.15 |
| 5,051,837 | A | 9/1991 | McJunkin | 358/349 |
| 5,055,057 | A | 10/1991 | Boyer | 439/134 |
| 5,073,122 | A | 12/1991 | Burke, Jr. | 439/134 |
| 5,190,466 | A | 3/1993 | McVey | 439/304 |
| 5,331,353 | A | 7/1994 | Levenson et al. | 348/725 |
| 5,338,212 | A | 8/1994 | Kerrigan | 439/134 |
| 5,427,543 | A * | 6/1995 | Dynia | 439/346 |
| 5,507,656 | A | 4/1996 | Ales | 439/133 |
| 5,641,298 | A * | 6/1997 | Holloway | 439/346 |
| 6,367,293 | B1 | 4/2002 | Elliott | 70/57 |
| 6,416,362 | B1 * | 7/2002 | Conrad et al. | 439/346 |
| 6,508,654 | B1 | 1/2003 | Tatz | 439/134 |
| 6,619,975 | B2 * | 9/2003 | Bentley et al. | 439/346 |
| 6,652,307 | B2 * | 11/2003 | Tatz | 439/346 |

FOREIGN PATENT DOCUMENTS

| | | | |
|---|---|---|---|
| WO | WO 02/41084 A1 | 5/2002 | G04G 15/00 |

* cited by examiner

*Primary Examiner*—Tho D. Ta
(74) *Attorney, Agent, or Firm*—Lloyd W. Sadler

(57) ABSTRACT

This invention secures an electrical plug by inserting a locking pin through a hole in the prong(s) of a male plug or through a hole in a female plug and through a corresponding hole in the male or female receptacle that secures the device plugged into the receptacle. The locking pin is secured by a latching system or locking mechanism that limits access to those not authorized. This invention may be used in conjunction with access-control devices that control access to users of appliances such as video game systems, TVs, computers and the like.

2 Claims, 12 Drawing Sheets

PLUG LOCKING MECHANISM

BACKGROUND OF INVENTION

1. Field of the Invention

This invention relates to appliance locking mechanisms. More specifically, this invention relates to plug-locking mechanisms.

2. Description of Related Art

A variety of electrical plug locking mechanisms are used to secure or limit access to an electrical outlet and the device or appliance plugged into the electrical outlet. Typically, such mechanisms require expensive locking mechanisms and/or contain complex securing assemblies that add cost to the final product. In addition, many of these mechanisms are designed to keep a power plug from being inserted into an outlet instead of securing a plug in an outlet. Although these references may not constitute prior art, for general background material, the reader is directed to the following United States patents, each of which is hereby incorporated by reference in its entirety for the material contained therein: U.S. Pat. Nos.: 6,508,654, 6,367,293, 5,507,656, 5,338,212, 5,331,353, 5,190,466, 5,073,122, 5,055,057, 5,051,837, 5,046,157, 4,769,765, 4,484,220, 4,348,696 and PCT patent number: WO 02/41084 A1.

SUMMARY OF INVENTION

It is desirable to provide a low-cost plug-locking mechanism that secures a power cord by placing a locking pin through holes in the plug and through the receptacle.

Therefore, it is a general object of this invention to provide a plug-locking mechanism that locks a male plug and a female receptacle with a locking pin and a sliding mechanism.

It is a further object of an embodiment of this invention to provide a plug-locking mechanism that has a latch beam connected to the sliding mechanism and a locking ramp to secure the sliding mechanism.

It is a further object of an embodiment of this invention to provide a plug-locking mechanism that has a locking ramp connected to the sliding mechanism and a latch beam to secure the sliding mechanism.

It is a further object of an embodiment of this invention to provide a plug-locking mechanism that has a latch beam connected to a locking pin and a locking ramp to secure the sliding mechanism.

It is a further object of an embodiment of this invention to provide a plug-locking mechanism that has a locking ramp connected to a locking pin and a locking ramp to secure the sliding mechanism.

It is a further object of an embodiment of this invention to provide a plug-locking mechanism that is secured within a lockable housing.

It is a further object of an embodiment of this invention to provide a plug-locking mechanism where the sliding mechanism has a locking hole for securing the sliding mechanism.

It is a further object of an embodiment of this invention to provide a plug-locking mechanism where the sliding mechanism is a sliding bar, a cam, a solenoid, and/or a push bar.

It is a further object of an embodiment of this invention to provide a plug-locking mechanism where the female or male power cord is connected to an appliance.

It is a further object of an embodiment of this invention to provide a plug-locking mechanism where power to the receptacle is controlled by an access controller.

It is a further object of an embodiment of this invention to provide a plug-locking mechanism where power to the receptacle is controlled by a card-reading access controller.

It is a further object of an embodiment of this invention to provide a plug-locking mechanism where the receptacle is in a power strip.

It is a further object of an embodiment of this invention to provide a plug-locking mechanism that locks a female receptacle with a locking pin and a sliding mechanism.

It is a further object of an embodiment of this invention to provide a plug-locking mechanism that locks a male plug and a female receptacle with a locking pin.

It is a further object of an embodiment of this invention to provide a plug-locking mechanism that locks a female plug and a male receptacle with a locking pin and a sliding mechanism.

It is a further object of an embodiment of this invention to provide a plug-locking mechanism that locks a female plug and a male receptacle with a locking pin.

These and other objects of this invention will be readily apparent to those of ordinary skill in the art upon review of the following drawings, detailed descriptions, and claims. In the present preferred embodiment of this invention, the plug-locking mechanism makes use of a novel locking mechanism by sliding a locking pin through a hole in a male or female power cord and a securing mechanism to hold the locking pin in place, which restricts access to unauthorized individuals.

BRIEF DESCRIPTION OF DRAWINGS

In order to show the manner in which the above-recited and other advantages and objects of the invention are obtained, a more particular description of the present preferred embodiments of this invention, which are illustrated in the appended drawings, is described as follows. The reader should understand that the drawings depict only present preferred and best mode embodiments of the invention, and are not to be considered as limiting in scope. A brief description of the drawings is as follows.

Reference will now be made in detail to the present preferred embodiments of the invention, examples of which are illustrated in the accompanying drawings.

DETAILED DESCRIPTION

Figure 1:
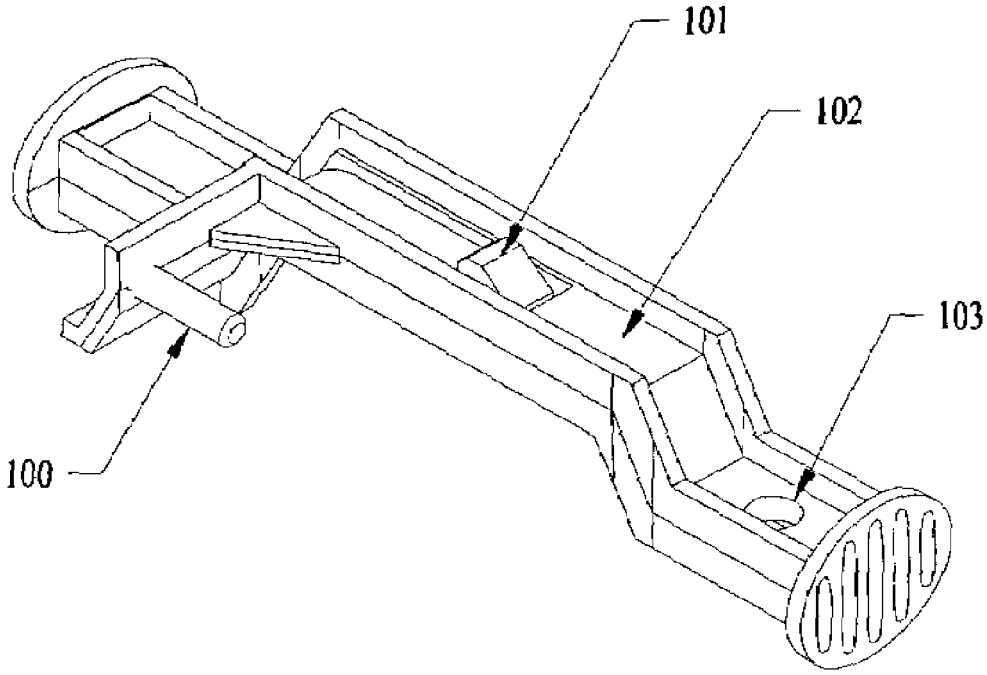
FIG. 1 is an angled view of the present preferred sliding bar pin-sliding mechanism with a latch beam and a locking hole.

FIG. 1 is an angled view of the present preferred sliding bar pin-sliding mechanism with a latch beam and a locking hole. The sliding bar 102 has a latch beam 101 that is flexible and can be used to secure the sliding bar 102. The sliding bar 102 has a connected locking pin 100. The sliding bar 102 is a type of pin-sliding mechanism used to move the locking pin 100. The sliding bar also has a locking hole 103 which can be used to secure the sliding bar 102 by placing a paddle lock or other types of locks through the locking hole 103.

Figure 2:
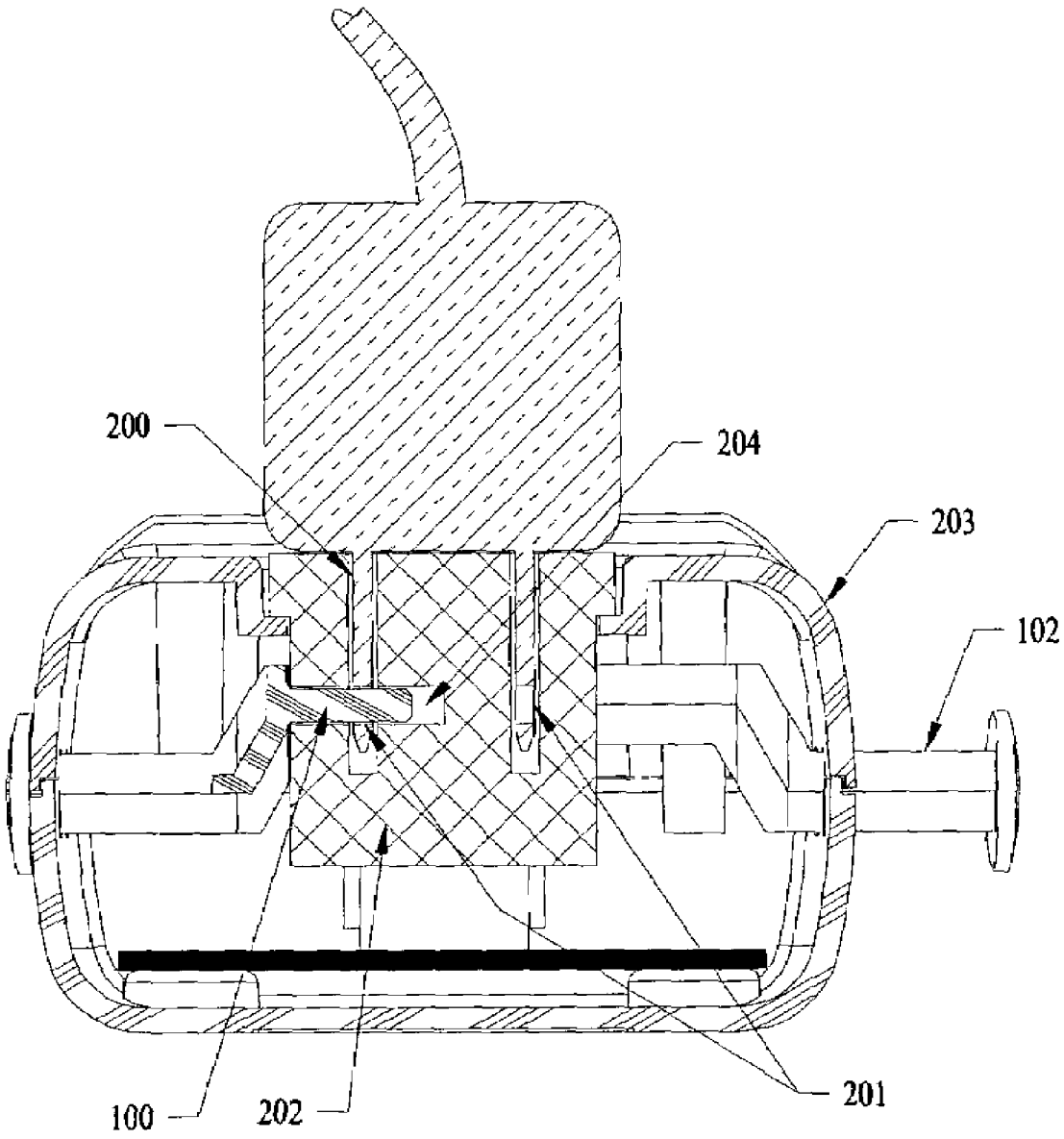
FIG. 2 is a side view of the present preferred sliding bar and locking pin securing a male power cord plug with a female receptacle.

FIG. 2 is a side view of the present preferred sliding bar and locking pin securing a male power cord plug with a female receptacle. A male power cord plug 200 that has one or more prong holes 201 plugs into a female receptacle 202. The female receptacle 202 has a receptacle hole 204. The male power cord plug 200 can have a transformer as shown or the male power cord plug 200 can be just a male power cord plug 200. The sliding bar 102 can be slid in and out. FIG. 2 shows the sliding bar 102 where the locking pin 100 has locked the male power cord plug 200 by sliding through the prong hole 201 in the male power cord plug 200 and through the receptacle hole 204 in the female receptacle 202. The locking pin 100 can be slid out of the prong hole 201 and the receptacle hole 204 by pushing on the right side of the sliding bar 102. The housing 203 holds the sliding bar 102 and the female receptacle 202 in place.

Figure 3:
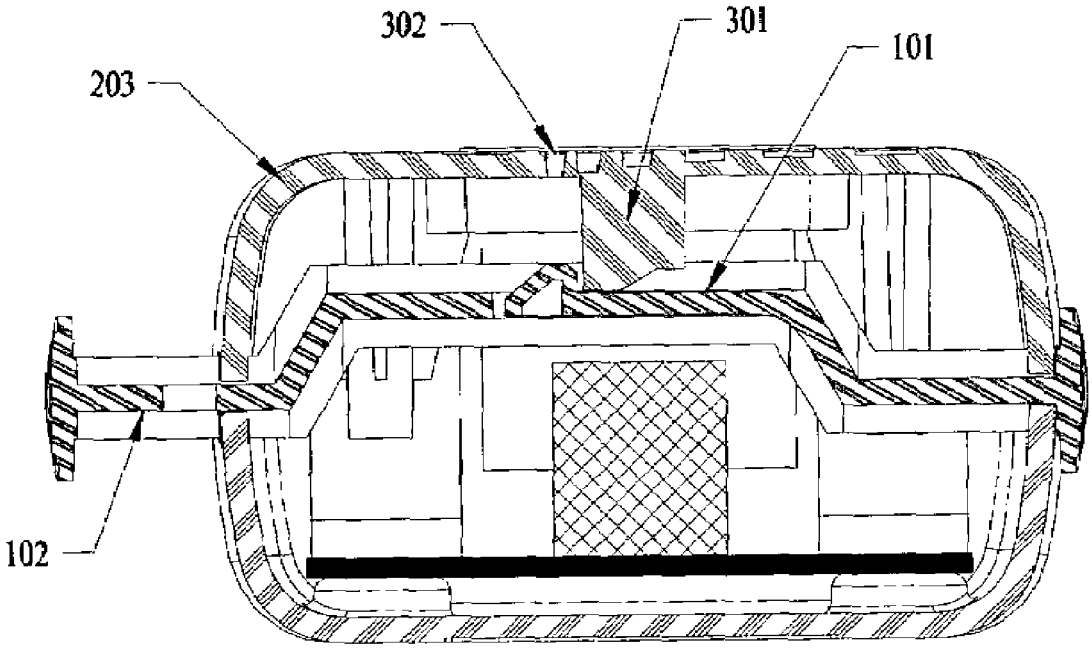
FIG. 3 is a side view of the present preferred embodiment showing a locking ramp and the latch beam securing a sliding bar.

FIG. 3 is a side view of the present preferred embodiment showing a locking ramp and the latch beam securing a sliding bar. When the sliding bar 102 is pushed from right to left, the latch beam 101 flexes as the latch beam 101 slides past the locking ramp 301 until the latch beam 101 slides completely over the locking ramp 301 and locks the sliding bar 102. This keeps the user from sliding the sliding bar 102 from left to right. A pin or other object can be inserted into the unlocking hole 302 so that the pin pushes on the latch beam 101 while sliding the sliding bar 102 to unsecure the sliding bar 102.

Figure 4:
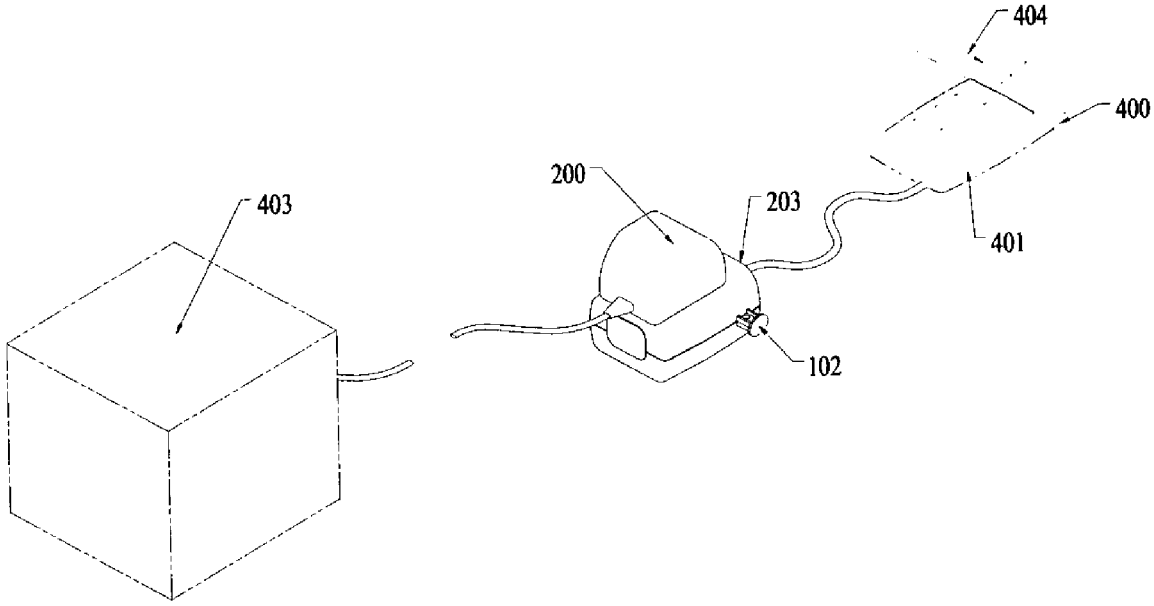
FIG. 4 is a drawing of the present preferred embodiment showing a male power cord plug connected to an appliance and a female receptacle connected to a card-reading access controller.

FIG. 4 is a drawing of the present preferred embodiment showing a male power cord plug connected to an appliance and a female receptacle connected to a card-reading access controller. The male power cord 200 is plugged into the female receptacle 202, which is in the housing 203. Power to the female receptacle 202 is controlled by an access controller 401, which has a card reader 400 used for granting access to an appliance 403, which is connected to the male power cord 200. If the user has not been granted access to the appliance 403 by the access controller 401, power is disconnected to the female receptacle 202, thus controlling access to the appliance 403. U.S. Pat. No. 5,046,157 shows how an access controller 401 with a card reader 400 grants access to an appliance 403 by sliding a magnetic card 404.

Figure 5:
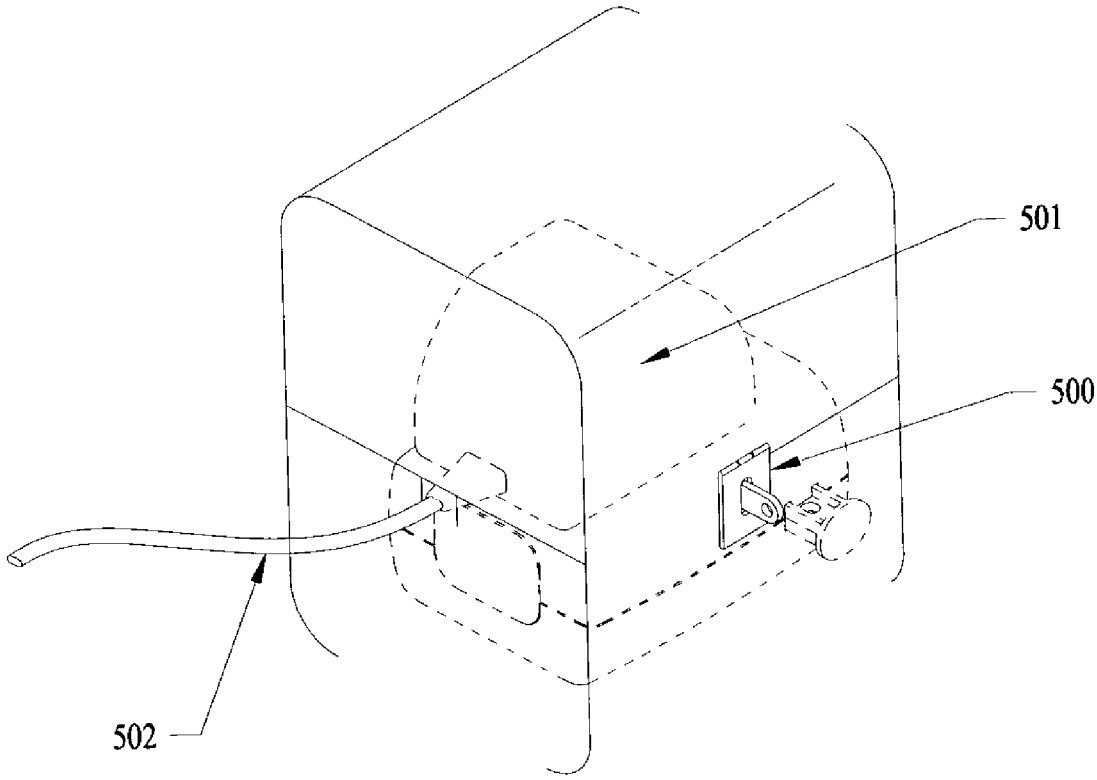
FIG. 5 is a drawing of the present preferred locking mechanism inside a lockable housing.

FIG. 5 is a drawing of the present preferred locking mechanism inside a lockable housing. The locking mechanism unit is secured within a lockable housing 500, which prohibits access to the locking mechanism once the male power cord plug 501 is secured. The lockable housing 500 has a hole in the lockable housing 500 so the power cord plug 501 that is connected to the power cord 502 can go through the lockable housing 500.

Figure 6:
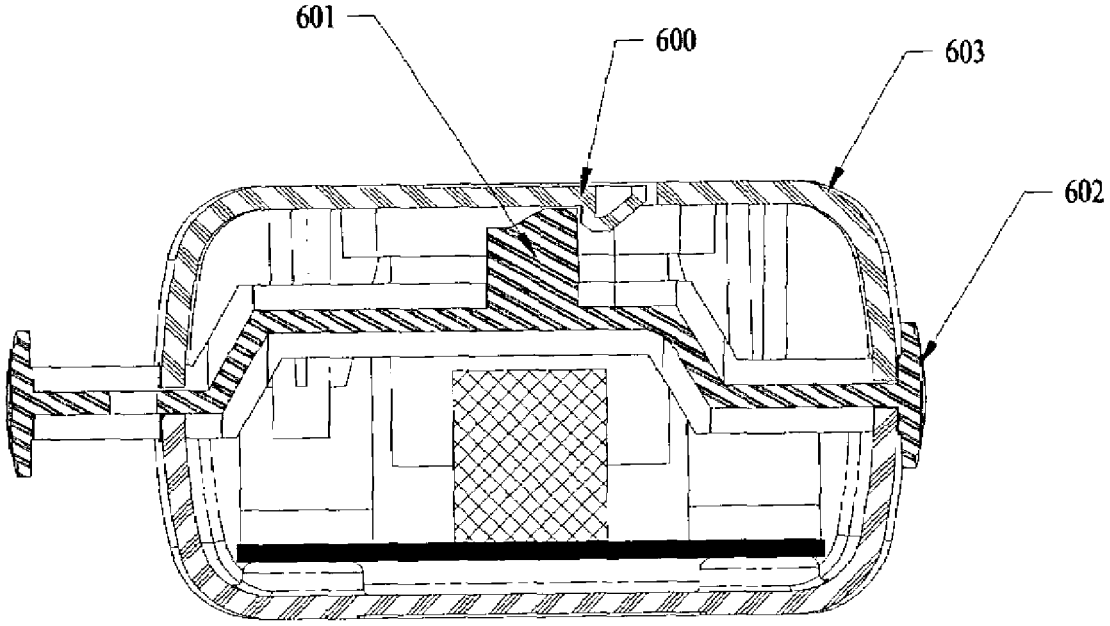
FIG. 6 is a drawing of the present preferred side view of the locking mechanism that shows a locking ramp attached to a sliding bar.

FIG. 6 is a drawing of the present preferred side view of the locking mechanism that shows a locking ramp attached to a sliding bar. The locking ramp 601 is connected to the sliding bar 602. The latch beam 600 is connected to the housing 603, which also holds the sliding bar 602 in place. When the sliding bar is slid from right to left, the locking ramp 601 slides over the latch beam 600 until the latch beam 600 secures the locking ramp 601 and the sliding bar 602.

Figure 7:
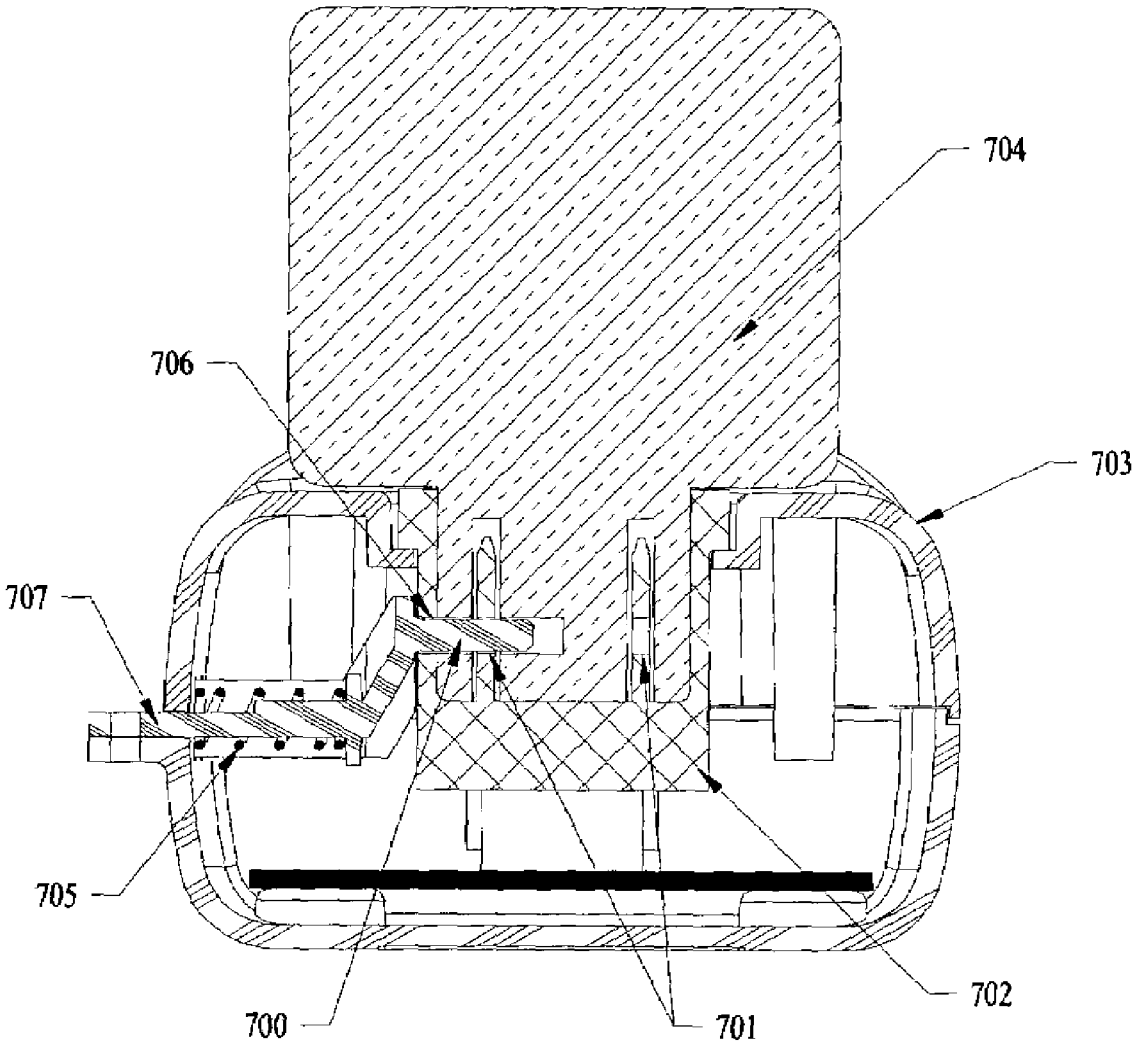
FIG. 7 is a drawing of the present preferred female power cord plug connected to a male receptacle that has a push bar sliding mechanism.

FIG. 7 is a drawing of the present preferred female power cord plug connected to a male receptacle that has a push bar sliding mechanism. A female power cord plug 704 with a plug hole 706 is inserted into a male receptacle 702 with a prong hole 701. The female power cord plug 704 can contain a transformer, as shown, or not. The locking pin 700, as shown, has slid through the plug hole 706 and through the prong hole 701 to secure the female power cord plug 704. The locking pin 700 is connected to a push bar 707. The push bar 707 is a type of pin-sliding mechanism used to move the locking pin 700. The push bar slides out via a spring 705 and in via a user pushing on the push bar 707.

Figure 8:
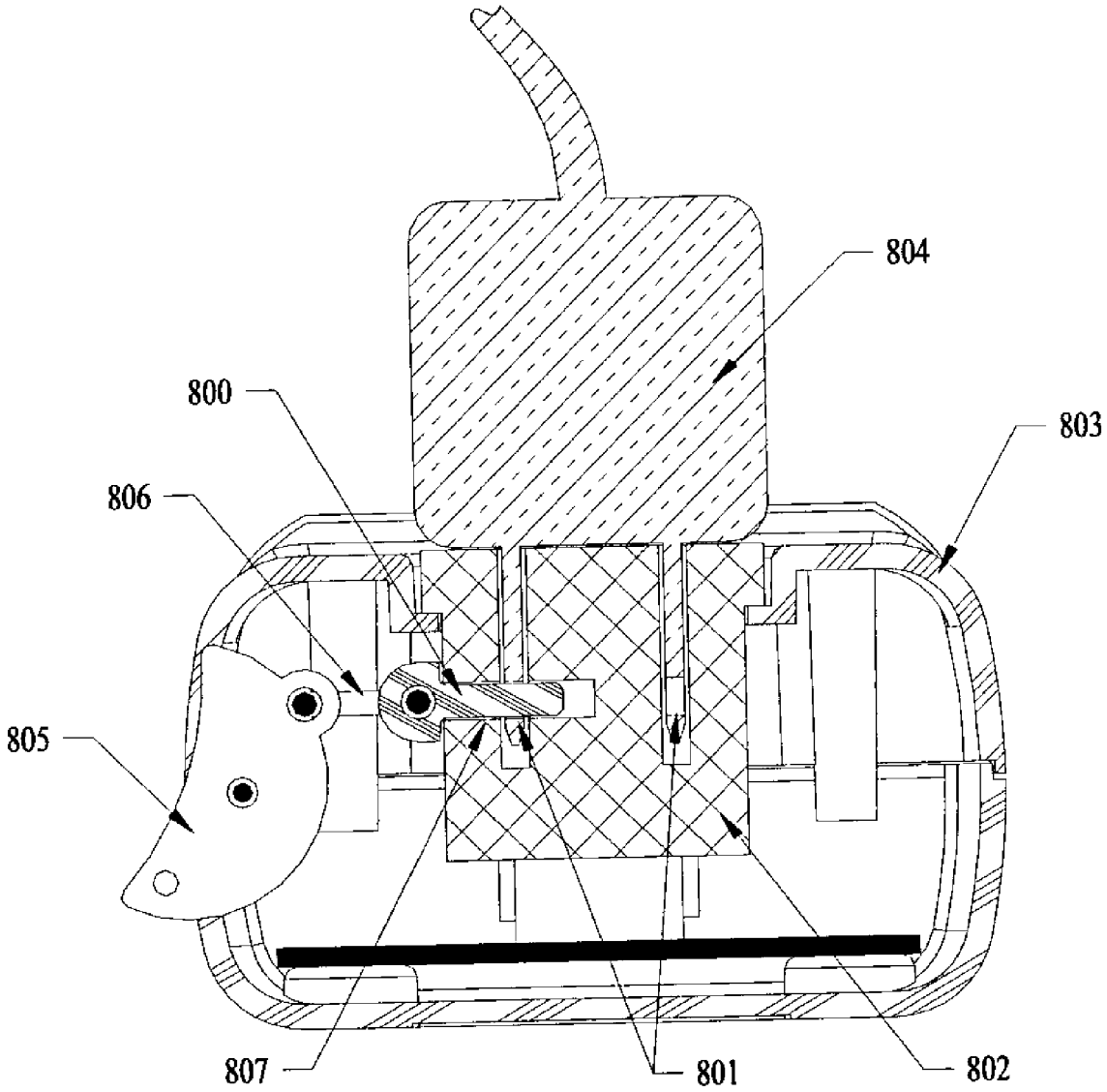
FIG. 8 is a drawing of the present preferred male power cord plug connected to a female receptacle that has a cam sliding mechanism.

FIG. 8 is a drawing of the present preferred male power cord plug connected to a female receptacle that has a cam sliding mechanism. The male power cord plug 804 is inserted into the female receptacle 802. The male power cord plug 804 can also include a transformer. In FIG. 8, the locking pin 800 has slid through the prong hole 801 and the receptacle hole 807 to secure the male power cord plug 804. The cam 805 is connected to the housing 803 and rotates when each side is pushed, thus pushing or pulling the locking pin 800 in and out. The cam 805 is a type of pin-sliding mechanism used to move the locking pin 800. The cam 805 is connected to the locking pin by a connecting bar 806. The connecting bar 806 is not necessary if the locking pin 800 connects directly to the cam 805 and the cam 805 has an elongated hole.

Figure 9:
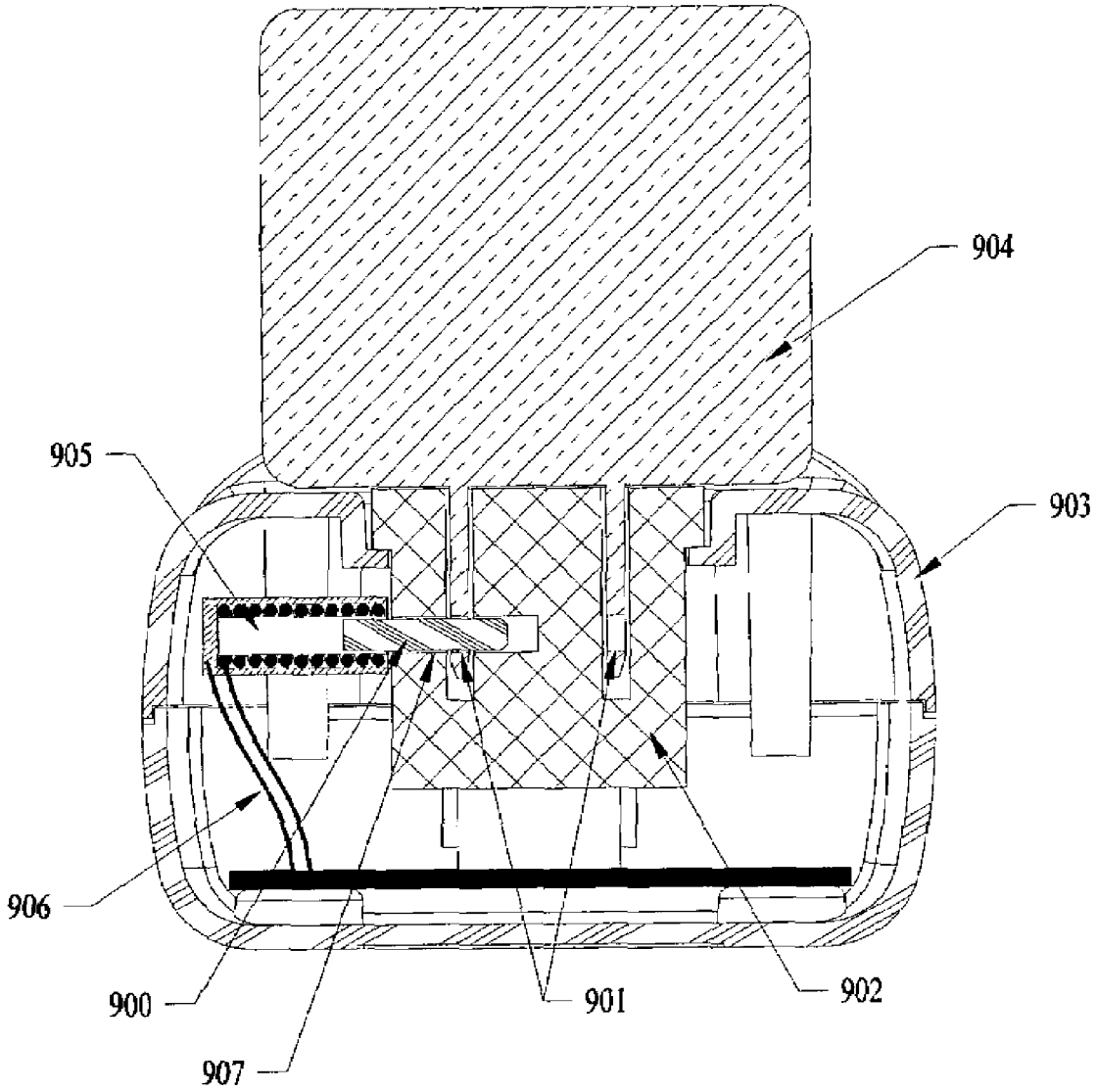
FIG. 9 is a drawing of the present preferred male power cord plug connected to a female receptacle that has a solenoid sliding mechanism.

FIG. 9 is a drawing of the present preferred male power cord plug connected to a female receptacle that has a solenoid sliding mechanism. The male power cord plug 904 with a prong hole 901 is inserted into the female receptacle 902 with a receptacle hole 907. The locking pin 900 slides through the receptacle hole 907 and the prong hole 901 to secure the male power cord plug 904. The solenoid 905 pushes the locking pin 900 in and out when power is applied or turned off to the solenoid 905 via wires 906 that are connected to the solenoid 905. This allows the male power cord plug 904 to be secured and released remotely, via software control, manual control, and the like. The solenoid 905 is a type of pin-sliding mechanism used to move the locking pin 900. The housing 903 holds the female receptacle 902 in place.

Figure 10:
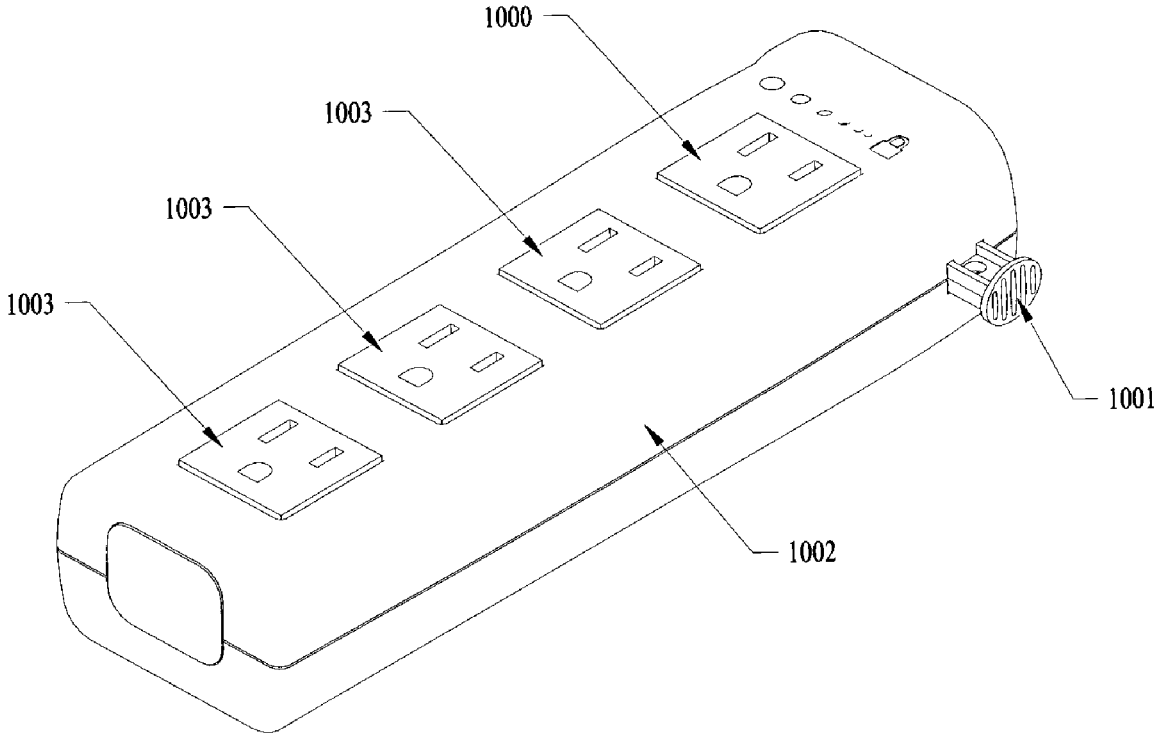
FIG. 10 is a drawing of the present preferred female receptacle and sliding bar locking mechanism that is housed in a power strip.

FIG. 10 is a drawing of the present preferred female receptacle and sliding bar locking mechanism that is housed in a power strip. The female receptacle 1000 is housed in a power strip 1002 to secure a male power cord being inserted into the female receptacle 1000 by sliding the sliding bar 1001. In this example, only one of the female receptacles 1000 can be secured while the other female receptacles 1003 cannot be secured. A model with a sliding bar for each outlet can be built, which would secure all the outlets in the power strip 1002.

Figure 11:
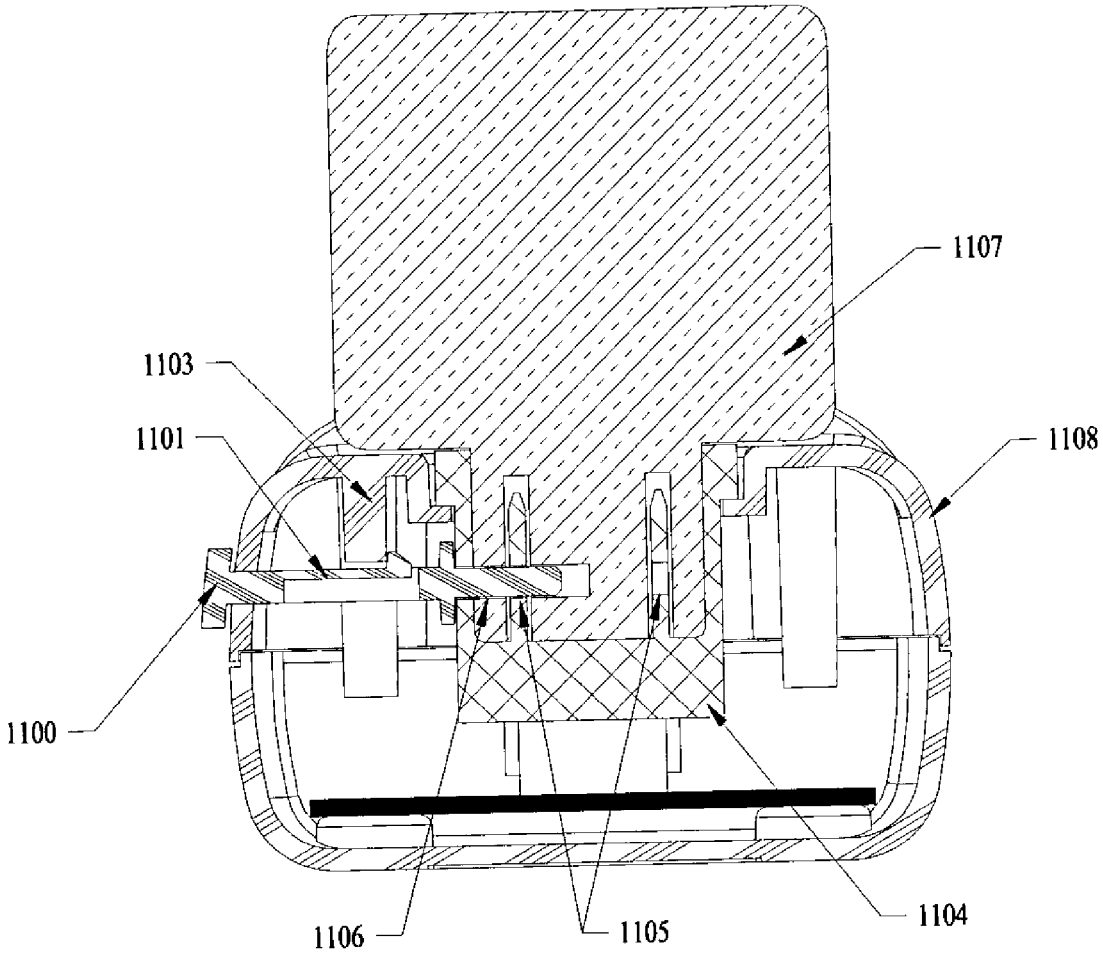
FIG. 11 is a drawing of the present preferred female power cord plug connected to a male receptacle that has a locking pin with a latch beam.

FIG. 11 is a drawing of the present preferred female power cord plug connected to a male receptacle that has a locking pin with a latch beam. A female power cord plug 1107 is plugged into a male receptacle 1104. The male receptacle 1104 has a prong hole 1105 and the female plug 1107 has a plug hole 1106. The locking pin 1100 slides through the plug hole 1106 and the prong hole 1105 to secure the female power cord plug 1107. A latch beam 1101, which is connected to the locking pin 1100, slides over the locking ramp 1103 until the latch beam 1101 secures the locking pin 1100, which also secures the female power cord plug 1107. The housing 1108 holds the locking pin 1100 and the locking ramp 1103 in place.

Figure 12:
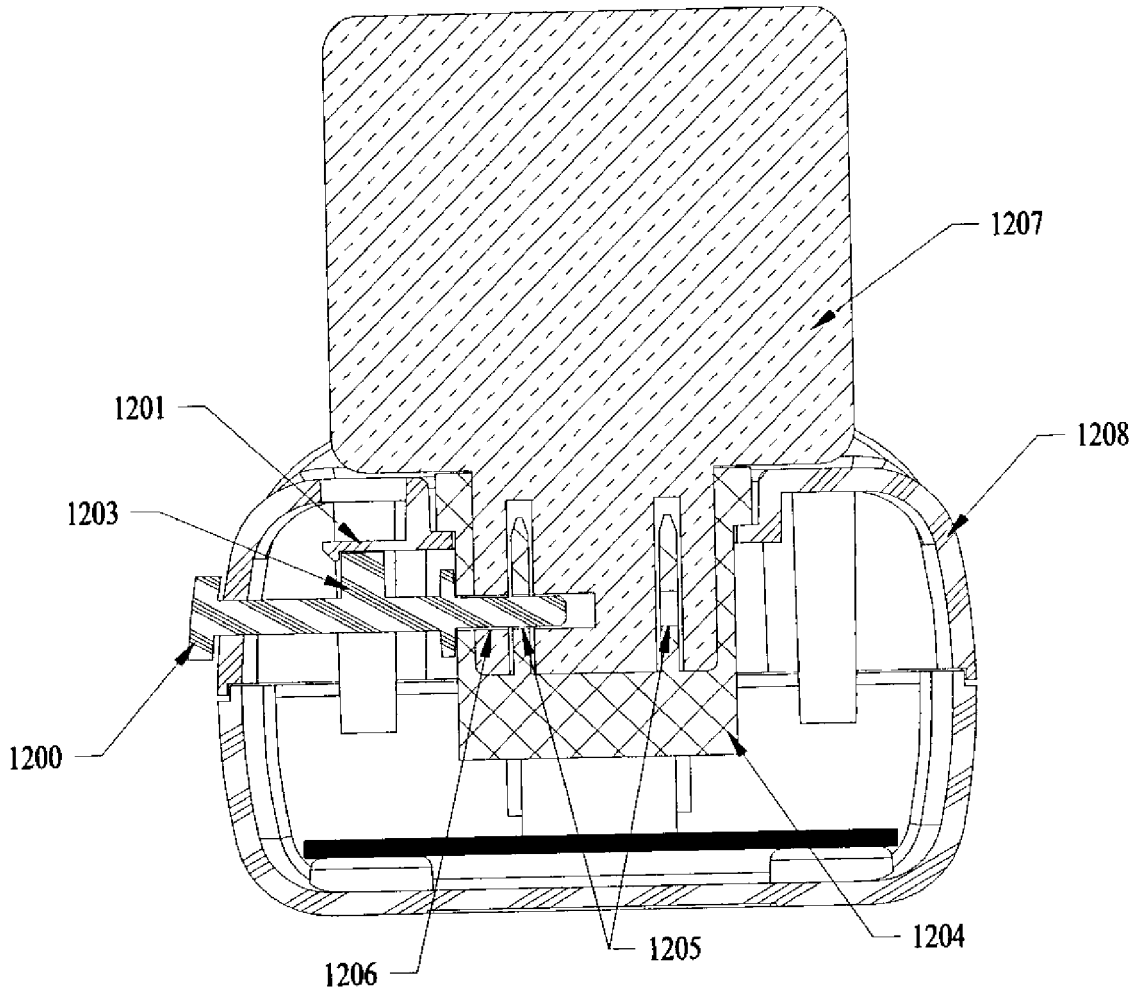
FIG. 12 is a drawing of the present preferred female power cord plug connected to a male receptacle that has a locking pin with a locking ramp.

FIG. 12 is a drawing of the present preferred female power cord plug connected to a male receptacle which has a locking pin with a locking ramp. A female power cord plug 1207 is plugged into a male receptacle 1204. The male receptacle 1204 has a prong hole 1205 and the female plug has a plug hole 1206. The locking pin 1200 slides through the plug hole 1206 and the prong hole 1205 to secure the female power cord plug 1207. A locking ramp 1203, which is connected to the locking pin 1200, slides over the latch beam 1201 until the latch beam 1201 secures the locking pin 1200, which also secures the female power cord plug 1207. The housing 1208 holds the locking pin 1200 and the latch beam 1201 in place.

Each of the embodiments of this invention can be constructed using a variety of materials, such as plastics, metals, composites, and the like. In addition, each of the embodiments can be machined, molded, and the like.

The described embodiments of this invention are to be considered in all respects only as illustrative and not as restrictive. Although specific diagrams are provided, the invention is not limited thereto. The scope of this invention is, therefore, indicated by the claims rather than by the foregoing description. All changes that come within the meaning and range of equivalency of the claims are to be embraced within their scope.

What is claimed is:

1. A plug-locking mechanism comprising:

A. a male power cord plug with a prong hole;

B. a female power cord receptacle with a receptacle hole that aligns with said prong hole when said male power cord plug is inserted into said female power cord receptacle;

C. a locking pin that slides through said receptacle hole and said prong hole to secure said male power cord plug; and D. a pin-sliding mechanism connected to said locking pin for sliding said locking pin in and out of said receptacle hole and said prong hole, wherein said pin-sliding mechanism has a locking hole used to secure said pin-sliding mechanism by placing a paddle lock or other types of locks through said locking hole.

2. A plug-locking mechanism comprising:

A. a female power cord receptacle with a receptacle hole;

B. a locking pin that slides through said receptacle hole; and

C. a pin-sliding mechanism connected to said locking pin for sliding said locking pin in and out of said receptacle hole, wherein said pin-sliding mechanism has a locking hole used to secure said pin-sliding mechanism by placing a paddle lock or other types of locks through said locking hole.

* * * * *